US008402777B2

(12) United States Patent
Yuhai et al.

(10) Patent No.: US 8,402,777 B2
(45) Date of Patent: Mar. 26, 2013

(54) INTELLIGENT DEFROSTING CONTROL METHOD FOR AN AIR CONDITIONER

(75) Inventors: Su Yuhai, Zhuhai (CN); Liu Guiping, Zhuhai (CN); Sun Changquan, Zhuhai (CN)

(73) Assignee: Free Electric Appliances Inc. of Zhuhai, Zhuhai, Guangdong (CN)

( * ) Notice: Subject to any disclaimer, the term of this patent is extended or adjusted under 35 U.S.C. 154(b) by 710 days.

(21) Appl. No.: 12/085,402

(22) PCT Filed: Nov. 24, 2006

(86) PCT No.: PCT/CN2006/003166

§ 371 (c)(1), (2), (4) Date: Aug. 31, 2009

(87) PCT Pub. No.: WO2007/059710

PCT Pub. Date: May 31, 2007

(65) Prior Publication Data

US 2010/0005816 A1 Jan. 14, 2010

(30) Foreign Application Priority Data

Nov. 25, 2005 (CN) ..... 2005 1 0101707

(51) Int. Cl.
*F25D 21/00* (2006.01)

(52) U.S. Cl. ..... 62/80; 62/151; 62/234

(58) Field of Classification Search ..... 62/80, 151, 62/234, 228.3, 157, 129, 211
See application file for complete search history.

(56) References Cited

U.S. PATENT DOCUMENTS

| | | | | |
|---|---|---|---|---|
| 5,193,610 | A * | 3/1993 | Morissette et al. | 165/54 |
| 6,209,622 | B1 * | 4/2001 | Lagace et al. | 165/8 |
| 6,889,750 | B2 * | 5/2005 | Lagace et al. | 165/8 |
| 7,073,566 | B2 * | 7/2006 | Lagace et al. | 165/8 |
| 2001/0013404 | A1 * | 8/2001 | Lagace et al. | 165/8 |
| 2002/0050338 | A1 * | 5/2002 | Lagace et al. | 165/54 |
| 2002/0139514 | A1 * | 10/2002 | Lagace et al. | 165/54 |
| 2006/0151165 | A1 * | 7/2006 | Poirier | 165/247 |
| 2006/0219381 | A1 * | 10/2006 | Lagace et al. | 165/8 |

* cited by examiner

*Primary Examiner* — Mohammad Ali
(74) *Attorney, Agent, or Firm* — Morris Manning & Martin, LLP; Tim Tingkang Xia, Esq.

(57) ABSTRACT

An intelligent defrosting control for an air conditioner is disclosed, which comprises the following steps: setting a standard air pressure value; placing a high-pressure sensor on the exhaust pipe of the compressor of the air conditioner to measure the air pressure; When the air pressure measured by the high-pressure sensor is lower than the standard air pressure value, said air conditioner begins to come into the defrosting mode; otherwise, said air conditioner working in previous mode.

5 Claims, 3 Drawing Sheets

INTELLIGENT DEFROSTING CONTROL METHOD FOR AN AIR CONDITIONER

FIELD OF THE INVENTION

This invention relates to the air conditioner defrosting control field, especially to an intelligent defrosting control for an air conditioner.

BACKGROUND OF THE INVENTION

At present, most air-source heat pump air conditioner units adopt time defrosting control (see FIG. 1 for the defrosting period), or the defrosting is controlled by measuring the surface temperature of the finned tube of outdoor heat exchanger. However, these two defrosting control methods are prone to cause frost-free defrosting in cold regions of north China, which is bound to result in energy waste. In addition, there's a defrosting control method based on the air pressure drop passing the finned tube. The defect of this method is that: once the finned tube of outdoor heat exchanger is jammed by dusts, false judgment is caused, which also results in waste.

SUMMARY OF THE INVENTION

The purpose for this invention is to provide a defrosting control method for air conditioner that can automatically judge whether enter the defrosting process.

In order to achieve the foregoing object, the invention provides the technical solution as follows:

An intelligent defrosting control method for an air conditioner, which including:

Step 1: Setting a standard air pressure value;

Step 2: placing a high-pressure sensor on the exhaust pipe of the compressor of the air conditioner to measure the pressure of the high pressure refrigerant;

Step 3: When the pressure of the high pressure refrigerant measured by the high-pressure sensor is lower than the standard air pressure value, the air conditioner begins to come into the defrosting mode; otherwise, the air conditioner continues working in previous mode.

In said Step 1, the standard air pressure value is preset in the control program of the air conditioner.

When the air conditioner comes into the defrosting mode, turn on the jet steam system of the air conditioner to inject refrigerant gas for the compressor.

The intelligent defrosting control method for air conditioner also includes putting a low-pressure sensor into the suction pipe of the compressor to measure gas pressure value.

An valve with adjustable opening is installed at the injection orifice of the jet steam system for adjusting the pressure of the injected refrigerant, so as to make the pressure value of the injected refrigerant gas equal to the square root value of the product of the pressure value of the high pressure refrigerant acquired by the high-pressure sensor and the air pressure value acquired by the low-pressure sensor.

By comparing with the existing technology, the intelligent defrosting control method for air conditioner according to this invention acquires system operating pressure value of the high pressure refrigerant by setting a high-pressure sensor on the exhaust pipe of the compressor, and then comparing the acquired pressure value of the high pressure refrigerant with a preset standard air pressure value, and finally deciding whether enter the defrosting process. Therefore, the frost of the outdoor heat exchanger can be judged in a correct way. In this way, the times of air conditioner defrosting are decreased, heating effect is improved, and energy is saved.

DETAILED DESCRIPTION OF THE INVENTION

Figure 1:
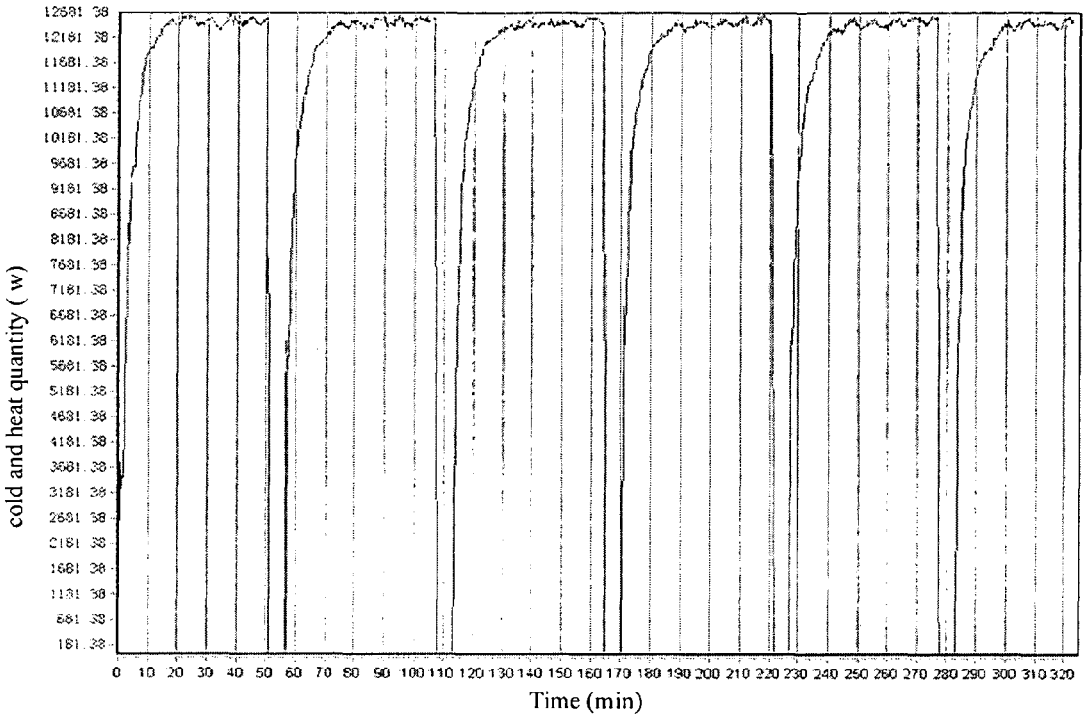
FIG. 1 is a schematic drawing for the air conditioner defrosting period employing the defrosting control method of the existing technology.

This invention is an intelligent defrosting control method for air conditioner 100. When an air conditioner unit 100 is in heating operation under the case of outdoor low temperature, a high-pressure sensor 102 is put on the exhaust pipe 104 of the compressor 106 to measure the air pressure value of the high pressure refrigerant of the air conditioner 100. Besides, a standard air pressure value is preset in the control program of the air conditioner 100 as the basis for judgment. Of course, the said standard air pressure value can also be preset in other control program. The control process is carried out by comparing the result of the measured pressure value of the high pressure refrigerant and the preset standard air pressure value.

If the -pressure value of the high pressure refrigerant measured by the sensor 102 is lower than the preset standard air pressure value of the program, the air conditioner 100 enters the defrosting process; otherwise, the air conditioner 100 runs according to the previous process. The defrosting process and the previous process are the operating procedures of the existing air conditioner which may be chosen by technicians in this field according to demands. When an air conditioner runs its defrosting program, it is better to turn on the jet steam system 108 of the air conditioner 100, and inject the refrigerant gas with intermediate pressure for the compressor 106 of the air conditioner 100, so as to increase the heat exchange amount of the outdoor heat exchanger of the air conditioner 100.

Figure 2:
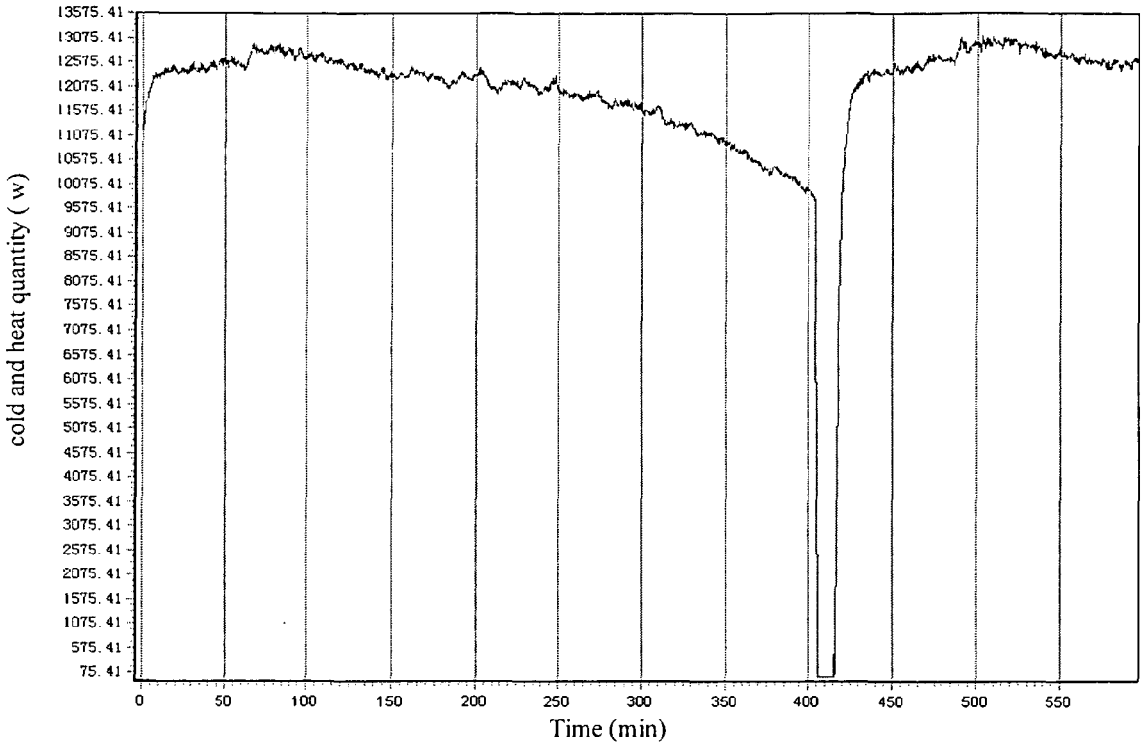
FIG. 2 is a schematic drawing for the defrosting period employing the intelligent defrosting control method for air conditioner according to the present invention.
Figure 3:
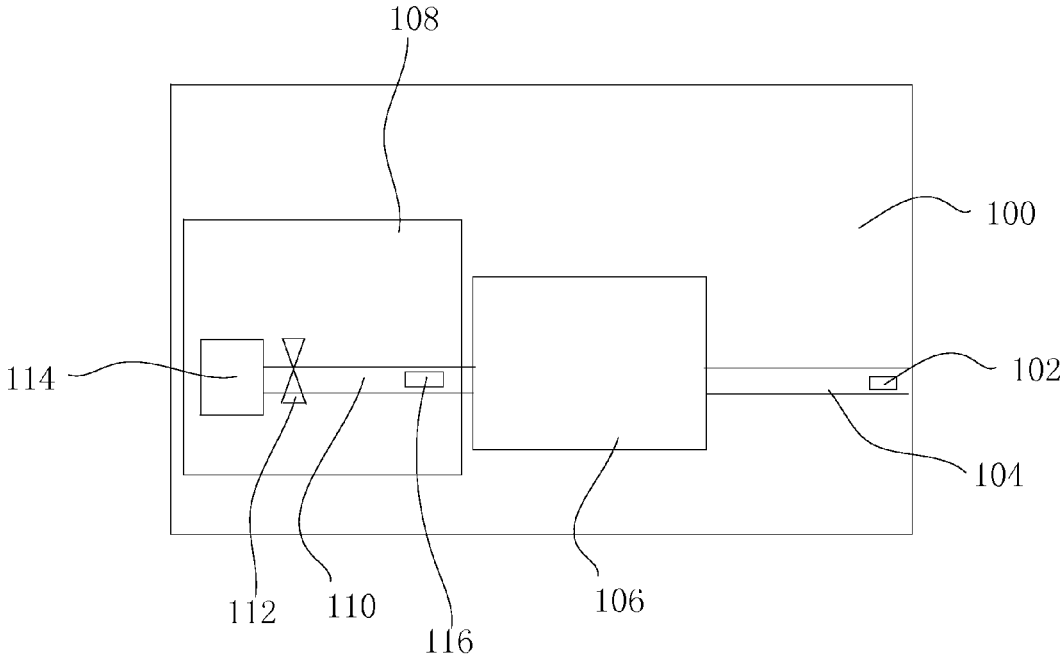
FIG. 3 is a schematic drawing for a setup for performing the intelligent defrosting control method for air conditioner according to the present invention.

In one embodiment of the intelligent defrosting control method for air conditioner 100 according to this invention, following steps are included. step 1: set a standard air pressure value in a control program of the air conditioner 100, and in this embodiment, the standard air pressure value is 1.46-1.73 MPa; step 2: place a high-pressure sensor 102 on the exhaust pipe 104 of the compressor 106 of the air conditioner 100 to measure the pressure of the high pressure refrigerant; step 3: when the pressure of the high pressure refrigerant measured by the high-pressure sensor 102 is lower than the standard air pressure value, the air conditioner 100 comes into the defrosting mode; otherwise, the air conditioner 100 runs according to the previous mode. The diagram for its defrosting period is shown in FIG.2.

In order to increase the heat exchange amount of the outdoor heat exchanger of the air conditioner 100 and shorten the defrosting time of the air conditioner 100, when the air conditioner 100 comes into the defrosting mode, the jet steam system 108 can be turned on to inject refrigerant gas for the compressor 106. This jet steam system 108 comprises the suction pipe 110 connected to the compressor 106, the valve 112 with adjustable opening and the reservoir 114 set on the suction pipe 110, and the low-pressure sensor 116 set outside the suction pipe 110. The gas pressure value in the suction pipe 110 of the compressor 108 is acquired through the low-pressure sensor 116. In this embodiment, the opening size of the valve 112 of the jet steam system 108 can be adjusted to adjust the pressure of the injected refrigerant, so as to make the pressure value of the injected refrigerant gas equal to the square root value of the product of the pressure value of the high pressure refrigerant measured by the high-pressure sensor 102 and the gas pressure value measured by the low-pressure sensor 116, so as to adjust the pressure of the refrigerant supplemented to the compressor, and to improve the heating output and energy efficiency ratio of the compressor 100.

This invention introduces a method that judging whether defrosting is feasible by measuring the pressure value of the high pressure refrigerant on the exhaust pipe 104 of the compressor 106 in the application of air conditioner systems, which cannot be deemed as limitation to the claims of this invention. It will be obvious to one of average skill in the art that nonmaterial and unobvious changes or improvement may be practiced within the scope of the invention.

The invention claimed is:

1. An intelligent defrosting control method for air conditioner, comprising the steps of:

(a) setting a standard air pressure value;

(b) placing a high-pressure sensor on an exhaust pipe of a compressor of the air conditioner to measure a pressure of the high pressure refrigerant; and (c) when the pressure of the high pressure refrigerant measured by the high-pressure sensor is lower than the standard air pressure value, the air conditioner beginning to come into a defrosting mode; otherwise, the air conditioner working in a previous mode.

2. The intelligent defrosting control method for the air conditioner according to claim 1, wherein, in the step (a), the standard air pressure value is preset in a control program of the air conditioner.

3. The intelligent defrosting control method for air conditioner according to claim 1, further comprising the step of, when the air conditioner comes into the defrosting mode, turning on a jet steam system of the air conditioner to inject refrigerant gas for the compressor.

4. The intelligent defrosting control method for the air conditioner according to claim 3, further comprising the step of putting a low-pressure sensor into a suction pipe of the compressor for measuring the gas pressure value.

5. The intelligent defrosting control method for the air conditioner according to claim 4, wherein an valve with adjustable opening is installed at the suction pipe of the compressor for adjusting the pressure of the refrigerant injected in the compressor, so as to make the pressure value of the injected refrigerant gas equal to the square root value of the product of the pressure value of the high pressure refrigerant acquired by the high-pressure sensor and the gas pressure value acquired by the low-pressure sensor.

* * * * *